United States Patent [19]

Johnson et al.

[11] 4,228,510

[45] Oct. 14, 1980

[54] CHARACTER GENERATOR

[75] Inventors: Walter J. Johnson, Seattle; James J. Selis, Renton, both of Wash.

[73] Assignee: The Boeing Company, Seattle, Wash.

[21] Appl. No.: 882,393

[22] Filed: Mar. 1, 1978

[51] Int. Cl.[3] ..... G06F 3/153

[52] U.S. Cl. ..... 364/521; 340/727; 340/731

[58] Field of Search ..... 364/521, 718, 719, 855; 340/324 A, 324 AD, 727, 731, 742

[56] References Cited

U.S. PATENT DOCUMENTS

| | | | |
|---|---|---|---|
| 3,775,760 | 11/1973 | Strathman | 340/324 A |
| 3,821,729 | 6/1974 | Schultze | 340/727 |
| 3,936,664 | 2/1976 | Sato | 340/324 AD X |
| 3,952,297 | 4/1976 | Stauffer et al. | 340/324 A |
| 3,976,991 | 8/1976 | Hickin et al. | 340/742 |
| 4,115,863 | 9/1978 | Brown | 364/719 X |

*Primary Examiner*—Jerry Smith
*Attorney, Agent, or Firm*—Cole, Jensen & Puntigam

[57] ABSTRACT

The characters are produced electronically through the implementation of character instructions which are stored in a memory in the form of a series of binary words. Each binary word is an instruction for producing a single straight-line portion, or stroke, of a complete character. Each such instruction word contains a count portion, which identifies the length of the stroke, a slope portion, which identifies the slope of the stroke, and a visibility portion, which identifies the visibility of the stroke. The character generator includes a counter which is preset to the amount of the count portion of each instruction word. The counter is counted down by a clock operating at a predetermined frequency. The slope portion of each instruction word is converted by a decoder into its respective X and Y component parts. These X and Y components are then applied to separate data channels which include adder/subtractor units under the control of the clock. A cumulative voltage signal is produced by each data channel and is applied to electron beam deflection circuits, which control the movement of the beam accordingly to construct the desired character.

8 Claims, 4 Drawing Figures

CHARACTER GENERATOR

BACKGROUND OF THE INVENTION

This invention relates generally to the art of character generators, and more specifically concerns a character generator for a visual display device wherein the characters are produced from a plurality of stored binary words.

Graphics, in the form of cathode ray tube (CRT) displays, including characters, maps, and other visual representations, are being increasingly used to impart information to viewers. There is hence currently a significant emphasis on improving both (1) the quality of the graphics, especially the quality of characters, so that they may be more readily understood by the viewer, and (2) the speed of character generation, so that complete displays may be produced in minimum time.

Present systems generally suffer from two major disadvantages. First, those systems which are fast generally produce relatively poor quality characters, and vice versa. There is no presently known system which produces high quality characters at high speeds. Second, most character generators today use stored instructions to generate characters. These instructions are typically quite long, however, and hence consume a substantial amount of memory space, which is undesirable in most applications.

In view of the above, it is a general object of the present invention to overcome one or more of the disadvantages of the prior art mentioned above.

It is an object of the present invention to provide such an apparatus which produces high quality characters at speeds approaching or exceeding the fastest available generators.

A further object of the present invention is to provide such an apparatus wherein the stored instruction words use a minimum amount of memory space.

It is an additional object of the present invention to provide such an apparatus which is capable of running at a fast constant frequency.

It is a still further object of the present invention to provide such an apparatus which is capable of changing character size without adding memory space.

It is yet another object of the present invention to provide such an apparatus which is capable of rotating a character.

SUMMARY OF THE INVENTION

Accordingly, a character generator is provided for use with an electron beam controlled display in which the movement of the electron beam to generate a usable character on the display is determined by a set of instruction words. Each instruction word in a set includes slope and count information for generating one straight-line portion of a character. The slope information determines the slope of the straight line portion on the display and the count information determines the length of the straight-line portion of the display. The generator includes a number of different elements. A memory means is provided to store a plurality of instruction words. Means are provided for retrieving each instruction word in turn in a set of instruction words to produce a given character. A counter is provided which is capable of being preset to a desired value, and means are provided for setting the counter to the value of the count information in an instruction word. A clock is provided which is set to run at a frequency which is selected so that the resulting period between successive clock pulses corresponds to the amount of time desired to generate a section of the straight line portion of the given character corresponding to the instruction word. Means are also provided to connect the clock to the counter such that, in operation of the generator, the clock will count down the counter at the rate of the selected frequency, wherein a counter pulse is produced in response to each clock pulse. Lastly, signal means are provided which are responsive to the counter pulses and the slope information in the instruction word to produce output signals which may then be applied to known deflection circuits in order to move the electron beam on the display sufficiently to produce successive sections of the straight line portion corresponding to the instruction word.

DESCRIPTION OF THE DRAWINGS

A more thorough understanding of the invention may be obtained by a study of the following detailed description taken in connection with the accompanying drawings in which.

DESCRIPTION OF PREFERRED EMBODIMENT

Figure 1:
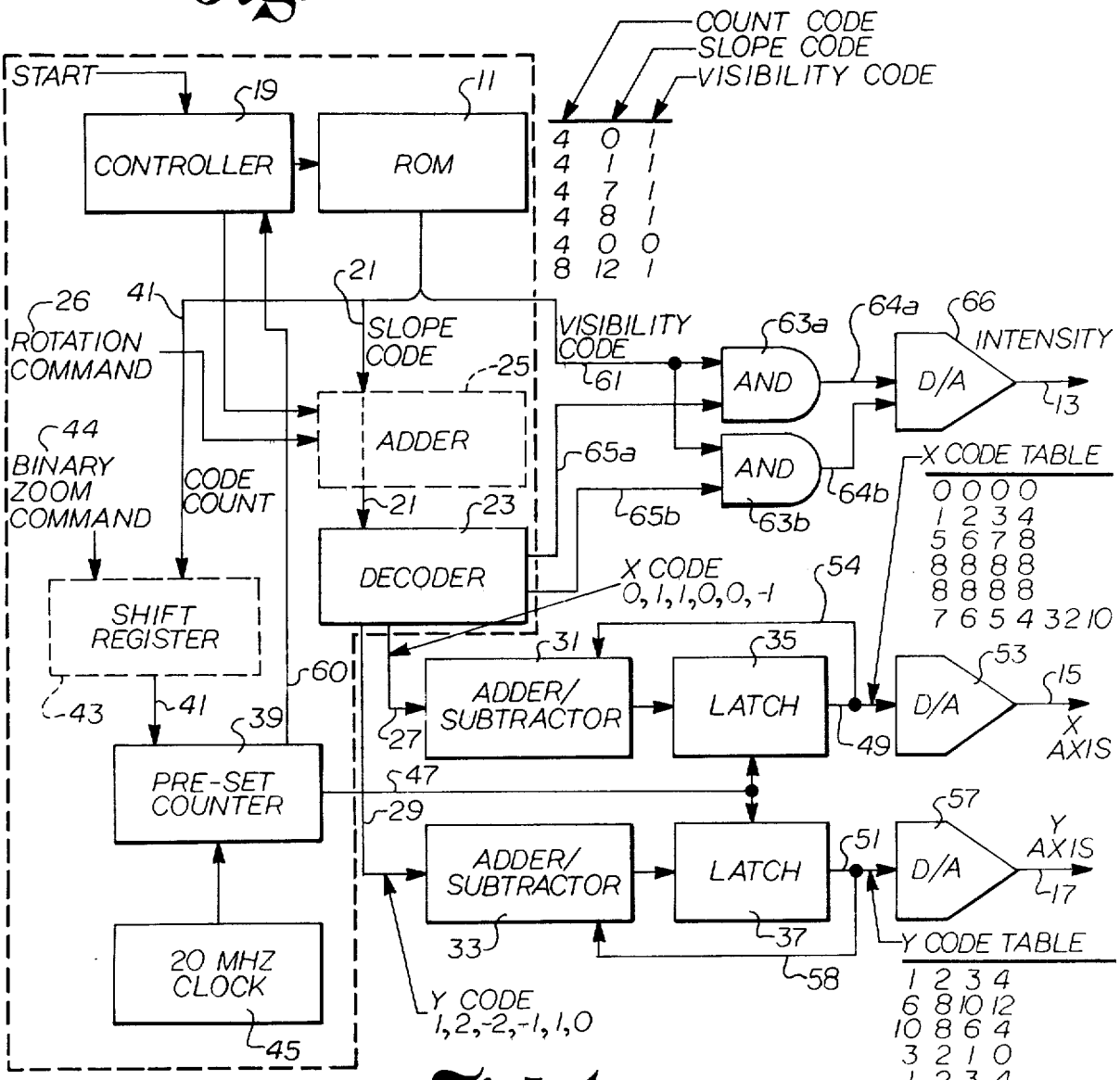
FIG. 1 is a block diagram of the apparatus of the present invention.

The apparatus shown in FIG. 1 is a circuit for generating electrical signals which in turn are used to produce a character on a visual display device, such as a cathode ray tube (CRT). The electrical signals control conventional deflection circuits which in turn control the movement of the electron beam in the cathode ray tube. The technology for producing characters on a cathode ray display with electrical control signals is well known, and hence details of such apparatus is not disclosed herein.

The present invention concerns a circuit for producing the above-noted electrical control signals. As seen from the example of the character A in FIG. 2, the visible characters produced using the control signals generated by the circuit of FIG. 1 are comprised of a connected series of straight lines, referred to herein as strokes. A series of instruction words, one for each stroke, define each character. The instruction words are stored in a read-only memory (ROM) 11 in a binary format.

The number of instruction words necessary for a given character will depend upon the complexity of that character. The character A in FIG. 2, for instance, comprises a total of six strokes, and hence, six instruction words are stored in ROM 11 for that character. Different characters or different configurations of the same character, will require different numbers of strokes, and the number of instruction words in ROM 11 will differ accordingly.

Each instruction word stored in ROM 11 comprises three principle portions or fields; specifically, a count field, a slope field and a visibility field. In the code arrangement shown and described for the embodiment of FIG. 1, the count field comprises four bits, the slope field comprises four bits, and the visibility field comprises one bit. Hence, each instruction word is typically nine bits wide. Additional bits may be added which indicate the end of the character or initial position of the character or other information about the character. The size of the instruction word and also the number of bits comprising each particular field may thus vary to some degree, depending upon the desired character size, the total number of possible slopes desired, as well as other variables mentioned above.

In the present invention, the nine bit instruction word completely describes one character stroke. No additional information is required to produce that one stroke. The character control information actually stored in memory is relatively compact in size compared with the amount of control information used in prior art systems; hence, memory space is efficiently used in the system of the present invention.

Figure 2:
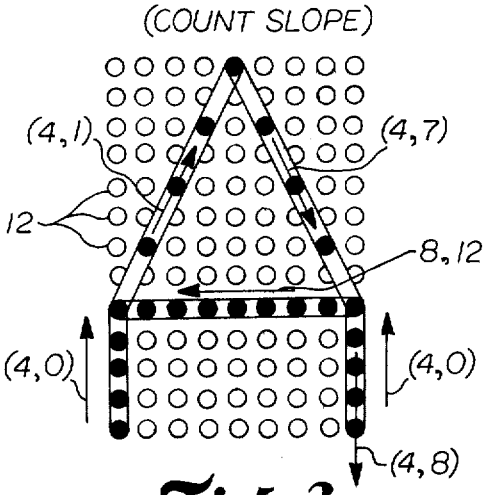
FIG. 2 is a representation of a particular character generated by the apparatus of FIG. 1.
Figure 3:
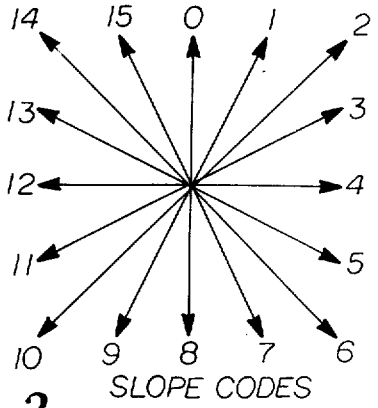
FIG. 3 is a diagram showing the various slopes which are available to produce a given character through the apparatus of FIG. 1.

FIGS. 2 and 3 clarify the use of the count and slope fields of an instruction word to produce a particular character stroke. Referring to FIG. 2, a portion of a conventional CRT screen is shown, in which is illustrated a field of dots 12—12, which represent the quantized end portions for each count in a given stroke. The relative gain of the system will determine the actual distance of beam travel in a single count, and thus the location of the beam travel end points for single counts illustrated in FIG. 2.

Hence, the dots in FIG. 2 are for illustration purposes only, to facilitate explanation of the movement of the beam during a given stroke. As the electron beam moves between the dots in tracing out a character, the path of the beam is illuminated on the display. In the present invention, the beam moves between two end points (dots) in 50 nanoseconds, while an additional 25 nanoseconds is required to change the slope of the beam. The speed with which a character is generated thus will depend on its complexity. For the character A shown in FIG. 2, 1.925 microseconds is required.

The present invention uses a total of sixteen different slopes, designated 0–15 in FIG. 3. The slope portion of each instruction word identifies the angular direction of the beam stroke. Sixteen slopes has been found to provide sufficient versatility to produce high quality characters, another object of the present invention. A further degree of character versatility can be obtained, however, by going to a further binary level of slope capability, i.e. to 32 slopes. In the embodiment of FIG. 1, the four bit capacity of the slope field is capable of uniquely identifying all of the slopes labeled 0–15 in FIG. 3.

The count field of the instruction word determines the length of the stroke, and refers to the actual number of path sections comprising a particular stroke. Each path section is the physical distance on the display between two successive quantized end points in the particular stroke being generated. Hence, the length of the path section may change, depending on the slope specified in the instruction word, and thus, the number in the count field of the instruction word does not represent an absolute path length. Rather, the number in the count field refers to the number of path sections the beam will go through to complete the particular stroke.

The use of the count and slope fields can perhaps be more clearly understood by referring to the character A in FIG. 2. The beam starts in the lower left hand corner of the display matrix. It is assumed that the beam has been properly positioned relative to the screen to begin drawing the character. The first stroke of the A is vertical, which is produced by a count field of four and a slope field of zero. The next stroke is produced with a count field of four and a slope field of one. Each additional stroke for the A character will have particular count and slope values, as seen in FIG. 2, in which is specified the count and slope values for each stroke in parenthesis. In this manner, the complete character is constructed from a plurality of successive strokes.

In addition to the four bit count and slope fields, each instruction word includes a one-bit visibility field, which is either a zero or one. If the value is a one, the electron beam is on during a particular stroke, and if the value is a zero, the beam is off. For example, referring again to FIG. 2, the right hand leg of the A includes an upward retrace, which follows the downward trace of the leg, prior to the drawing of the horizontal bar. The upward retrace has count and slope fields of 4 and 0, respectively, and a visibility code of 0. The beam is off, because the leg already has been traced by the previous stroke.

A complete set of instruction words, each containing a count field, a slope field, and a visibility field, for the character A is shown next to ROM 11 in FIG. 1.

FIG. 1 shows in detail a block diagram of one embodiment of the present invention. The circuit of FIG. 1 uses the instruction words stored in ROM 11 to produce electrical control signals which are applied to conventional deflection circuits (not shown) which control the movement of the electron beam in the CRT. The instruction words are expanded in a manner described hereinafter to produce the desired electrical control signals.

The output of the character generator shown in FIG. 1 is three analog signals, shown at the far right of the figure. The signal on output line 13 is applied to an intensity control grid in the CRT tube and controls the illumination intensity of the character, as well as whether the beam is on or off. The signal on output line 15 controls, through the X deflection circuits, the amount of movement of the beam in the X or horizontal beam direction for successive beam movements, while the signal on output line 17 controls, through the Y deflection circuits, the amount of Y or vertical beam deflection for successive beam movements.

Each instruction word from ROM 11 is processed individually by the character generator, and each field of the instruction word is processed by separate sections in the character generator. In operation, an instruction word is called out of its location in ROM 11 by a process controller 19, which may, for instance, be a microprocessor of any one of a number currently available on the market. Alternatively, controller 19 could be a conventional timing circuit, such as a one-shot multivibrator, with an inhibit function.

At a start signal or an end-of-stroke signal from preset counter 39 on line 60, the controller simply locates the specified character in ROM 11 and the instruction word for the first stroke in the character is read out of ROM 11. The slope portion of the instruction word is provided on line 21 to a decoder 23. Alternatively, the slope field may be applied to one input of an adder 25, which along with a rotation command signal 26 forms an optional feature which causes the resulting character to partially rotate. This feature will be explained in more detail hereinafter.

Decoder 23 is a combination of AND and OR gates, and produces two output signals from the one slope field input signal. The design of decoder 23 is relatively simple and is within the ordinary skill of the art. The various gates are arranged such that a particular input value, for instance slope 1 in FIG. 3, will yield its two components, which for slope 1 are 2 and 1. One output signal from decoder 23, on line 27, is the value of the X component necessary to produce the slope represented by the slope value, and the other signal, on line 29, represents the Y component necessary to produce the slope value. The list of X code and Y code values in FIG. 1, shown with arrows leading to lines 27 and 29, respectively, are the respective X and Y components for the slopes of each stroke for the character A.

Note, for instance, that for the first stroke of the character A, when the slope field is zero, each discrete movement of the beam has an X component of zero, i.e. there is no horizontal beam deflection, and a Y component of 1, i.e. the beam moves one space in the vertical direction. For the second stroke, with a slope of one, each movement of the beam requires an X component of one, since the beam moves one space right horizontally, and a Y component of 2, since the beam moves two spaces up vertically.

Hence, the signals on lines 27 and 29 for one instruction word are digital signal representations of the X and Y components necessary to define the direction of the path of the beam movement for one stroke of the character.

As an alternative to using a decoder the X and Y components themselves could be substituted for the slope field value in the instruction word. This would, however, lengthen the instruction word and use more memory space, but would have the advantage of speeding up the signal rate.

The X signal on line 27 is applied as one input to an adder/subtractor circuit 31 while the Y signal on line 29 is applied as one input to an identical adder/subtractor circuit 33. Adder/subtractor circuits 31 and 33 are conventional. A suitable adder/subtractor implemented in transistor-to-transistor (TTL) logic is referenced conventionally as 74S181. The output of the adder/subtractors 31, 33, respectively, is applied to latch circuits 35 and 37, which are controlled by the output of a preset digital counter 39. Suitable latch circuits in TTL logic can be purchased under the designation of 74S174, 175.

Latch circuits 35 and 37, produce an output in response to a count being generated by a preset counter 39 and applied to the latch circuits. Counter 39 is a conventional preset counter, which is initially set to the value of the count field of the instruction word, obtained from ROM 11 over line 41. In an alternative embodiment, to be explained in more detail hereinafter, the count field is applied to a shift register 43, which is under the control of a binary zoom command signal 44. The binary zoom feature will be explained in more detail hereinafter. Shift register 43 is not a necessary part of the circuit of FIG. 1.

In operation, counter 39 is preset to the value of the count field in the instruction word. As decoder 23 is producing the X and Y component signals on lines 27 and 29 for application to the adder/subtractor units 31 and 33, a clock 45, which in the embodiment shown has a 20 megahertz frequency, counts counter 39 down to zero from its preset value. For a 20 megahertz clock frequency, counter 39 will produce output pulses on line 47 at 50 nanosecond intervals. The time interval between pulses on line 47 determines the time interval for the beam travel over successive path sections of a particular stroke.

The counter pulses on line 47 are applied to the control inputs of both latch circuits 35 and 37. In operation, each time a signal occurs at the control inputs of latch circuits 35 and 37, outputs are produced on lines 49 and 51, which extend, respectively, from circuits 35 and 37, which are equal to the output of the adder/subtractor units 31 and 33 during the last clock cycle. The output on line 49 is applied both to a digital/analog converter 53, and also as another input to adder/subtractor 31 on line 54.

Similarily, the output from latch circuit 37 on line 51 is applied as an input to digital/analog converter 57, and as another input to adder/subtractor 33 on line 58. Hence, the output signals on lines 49 and 51 are continuous accumulations of the X and Y components of the beam relative to the beginning beam position, which in FIG. 2 is the lower left hand corner of the matrix. The accumulation is shown word-by-word in the X and Y code tables positioned adjacent the digital/analog converters 53, 57 in FIG. 1.

The digital voltage signals on lines 49 and 51, respectively, are applied as indicated above, to digital/analog converters 53 and 57. The converters must be capable of running at a 20 megahertz rate, but such converters are currently commercially available. The output of digital/analog converter 53 is an analog voltage which is at a correct value to move the beam to the desired X location, i.e. the desired horizontal row, in the display matrix, while the output from digital/analog converter 57 moves the beam to the correct Y position, i.e. vertical column, in the matrix.

Combining the two signals results in the beam being positioned on the one correct quantized end point in the matrix which satisfies both the X and Y values. The beam moves between successive end points at a rate of 50 nanoseconds, creating a trace therebetween. When counter 39 is counted down to zero, a stroke has been completed, and a signal is sent over line 60 to controller 19, which then calls out the next instruction word from ROM 11. A character is thus generated in a very short time span, typically on the order of 2.1 microseconds, average.

As indicated above, the visibility bit, from ROM 11 on line 61 determines whether the electron beam is on or off. In certain applications, it may be desirable in addition to control the intensity of the beam on a stroke by stroke basis. For instance, the distance between successive end points in the first stroke of the character A is less than the distance between successive end points in the second stroke. Ordinarly, the second stroke would be less intense in illumination than the first stroke. In practice, it has been found by the inventors that with 16 slopes, there is usually insufficient difference in illumination to make a noticeable difference to the human eye, and hence, intensity control is not necessary for the embodiment of FIG. 1.

However, if the principles of the present invention are used in an embodiment using 32 or more slopes, or if a precise intensity level should become critical, there is shown in FIG. 1 a circuit for correcting the intensity variations caused by different slopes. The intensity modulation circuit in FIG. 1 comprises AND gates **63*a*–63*b*, to which lines 64*a*–65*b* from decoder 23 are applied. The visibility field bit on line 61 is also applied to each AND gate 63*a*–63*b***.

Assuming that the visibility bit is a one on line 61, the magnitude of the signals on lines 65a–65b will determine the intensity of the stroke on the display. Decoder 23 will provide the correct binary values on these lines, depending on the particular stroke being processed. There are output lines 64a, 64b from AND gates 63a and 63b, respectively, connected to digital/analog converter 66. The two output lines will provide a capability of four different quantized signal levels to digital-/analog converter 66. The resulting output from digital-/analog converter 66 can then be used to modulate the intensity of the beam, accordingly, to produce even level intensity.

Also illustrated in FIG. 1 are two additional structural features, one termed binary zoom command, and the other rotation command. These features are not necessary to the operation of the circuit of FIG. 1, but add additional character-generating capability. When it is desirable in a particular application to rotate the characters being generated, such as to draw characters at an angle, or around a dial, the rotation command feature, using adder 25, is utilized. By adding a particular numerical amount to the slope field of each instruction word in a character, the resulting character is oriented from the vertical by a corresponding angle. Any numerical amount added, from zero through 15, will produce a character at an angle equal to the slope identified with the amount added.

For instance, if a two is added to the slope field, the character A will be produced, undistorted, at a 45° angle from the vertical. Likewise, if a 4 is added, the undistorted character will be at a 90° angle from the vertical, or horizontal, pointing toward the right. Hence, any character angle from 0° to 360° , in 22.5° increments, can be produced by the apparatus of FIG. 1.

The binary zoom command features utilizes a shift register 43. This feature enlarges the character by a binary multipler. Hence, if it is desired to increase the character to twice its ordinary size, the normal count field on line 41, which may be, for instance, a four, is shifted one binary digit to the left, resulting in a count of eight which doubles the size of the character. Shift register 43 thus produces an increase in the size of the character in multiples of 2, when it is activated by the binary zoom command signal.

Alternatively, to increase the size of the character proportionately, each instruction word can be repeated, as many times as the desired increase.

Figure 4:
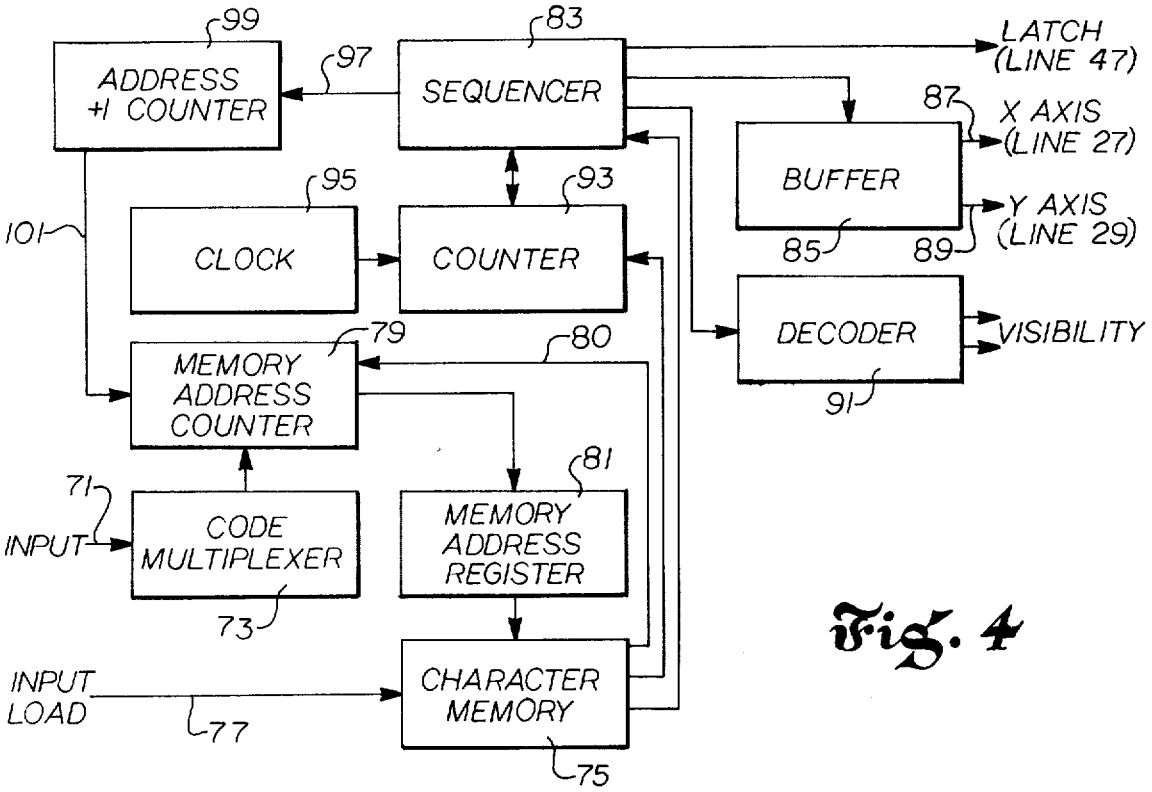
FIG. 4 is a more detailed block diagram of one portion of the present invention shown in FIG. 1.

Referring now to FIG. 4, a more detailed block diagram of a somewhat more sophisticated embodiment is shown for that portion of the character generator enclosed by the dashed lines in FIG. 1. When a particular character is to be produced by the generator of FIG. 4, the code for that character is applied as an input signal on input line 71 to a code multiplexer 73. Code multiplexer 73 is a conventional multiplex/demultiplex circuit which sorts out the various portions of the character code to determine how to draw the character. The character code may contain, for instance, font information, and display position information, as well as the character identifier. The character identifier is loaded into memory address counter 79 and then into memory address register 81. The character identifier points to an address for that character in an address table in memory 75, which in turn points to the location of the first instruction in memory 75 for the character.

The information in character memory 75 to draw the characters is loaded over line 77 under the control of conventional memory page circuits (not shown). Character memory 75 comprises, in the embodiment shown, two 2k by 12 bit sections. Memory 75 is a random access memory (RAM), but it could be a ROM as well.

The address of the first instruction in memory 75 is loaded back into memory address counter 79 over line 80. In the embodiment shown, a memory address counter is provided separate from memory address register 81, which comprises two register sections, so that a subsequent instruction address may be loaded into register 81 while the immediate prior instruction address is being used. This increases the speed of the apparatus, but is not necessary. If speed is not a factor, then register 81 may be eliminated.

At this point, sequencer 83 turns on, and the processing of an instruction word present at the pointed location in memory 75 begins. Sequencer 83, which operates like a state counter, is set to accomplish a specific routine each time it is actuated. It extracts the instruction word from memory 75, and loads the counter 93, buffer 87 and decoder 91 with the appropriate portions of the instruction word. The slope information, in X and Y component terms, is applied to buffer 85 and then to the X and Y adder/subtractor circuits shown in FIG. 1 over lines 27 and 29, respectively. The arrangement shown in FIG. 4 assumes that the slope information reaching buffer 85 is already in the form of X and Y components and hence, that a decoder as shown in FIG. 1 is not necessary. If the slope information in character memory 75 is in the form of a slope code, rather than X and Y components, then a decoding operation must be performed prior to the information reaching lines 27 and 29.

A portion of the instruction word is the visibility bit. This information is applied to decoder 91, which produces the desired visibility information for the stroke.

Counter 93 is set to the value of the count field in the instruction word, and then counts down under the control of clock 95. The counter signals are applied to sequencer 83, which in turn produces a pulse on line 47 (FIG. 1) each time a count from counter 93 is received. When the counter 93 reaches zero, the sequencer checks the particular instruction word extracted from memory 75 to determine whether an end-of-character bit was present in that particular instruction. If not, sequencer 83 applies a pulse on line 97 to an address-plus-one counter 99, which increments the memory address counter over line 101 by one, which in turn increments memory address register 81, in order to locate the next instruction word in memory 75 for the character.

The above cycle is repeated until an end-of-character bit is recognized, at which point sequencer 83 stops and waits for another request to be initiated. The operation of the remainder of the circuit, i.e. the follow-on circuitry indicated at the far right of FIG. 4, is identical to that of FIG. 1. The circuit of FIG. 4 is a somewhat more sophisticated alternative means for producing the X and Y component signals, as well as the visibility signal, in response to a character request, than that shown in FIG. 1.

Hence, a character generator has been described which uses instruction words requiring a minimum of memory space to generate, at high speed, characters of high quality.

It should be understood that various modifications and changes can be incorporated in the embodiment shown and described without departing from the spirit of the invention, which is defined by the claims which follow.

What is claimed is:

1. A character generator for use with an electron beam controlled display in which the movement of the electron beam to generate a visible character is determined by a set of instruction words, wherein each instruction word in the set includes slope, count and visibility information for generating one straight line portion of a character on the display, each straight line portion comprising a plurality of strokes, the length of the strokes varying depending on the slope of the straight line portion but equal within a given straight line portion, wherein the slope information is a single number representative of the particular slope of the straight line portion on the display and the count information is a number representative of the number of strokes in the straight line portion, and thus determines the length of the straight line portion on the display, the display being arranged so that a character is formed by a series of straight line strokes between matrix points which comprise the display, the distance between successive matrix points in the horizontal direction being referred to as a $\Delta X$ unit value, and the distance between successive matrix points in the vertical direction being referred to as a $\Delta Y$ unit value, the $\Delta X$ and $\Delta Y$ unit values being equal to the shortest stroke generated, the generator comprising:

a. memory means for storing a plurality of instruction words;

b. controller means for retrieving each instruction word in turn in a set of instruction words in order to produce a given character;

c. a counter capable of being preset to a desired value;

d. means setting said counter to the value of the count information in an instruction word;

e. a clock set to run at a frequency which is selected so that the period between successive clock pulses corresponds to the desired time to generate a stroke section of the straight line portion of the given character corresponding to the instruction word;

f. means connecting said clock with said counter such that in operation said clock counts down said counter at the selected frequency, wherein said counter produces a counter pulse in response to each clock pulse;

g. decoder means responsive to said slope information to provide $\Delta X$ and $\Delta Y$ display values which are appropriate multiples of the $\Delta X$ and $\Delta Y$ unit values representative of the orthogonal components of the successive strokes comprising the straight line portion on the display which the slope information represents;

h. means responsive to said decoder means for accumulating, at each counter pulse, the sum of the $\Delta X$ and $\Delta Y$ display values for the successive strokes in successive straight line portions of a character, until the character has been completed, said accumulating means including first and second series connections of an adder/subtractor means, a latch circuit, and means feeding back the output of the latch circuit back to the adder/subtractor means;

i. first and second digital-to-analog converters responsive to the latch circuits for converting the accumulated values of $\Delta X$ and $\Delta Y$ into corresponding analog values which may in turn be applied to deflection circuits in order to move the electron beam on the display sufficiently to produce successive stroke sections of the straight line portion corresponding to the instruction word; and j. gate means responsive to the visibility information in the instruction word and to said decoder means to produce a beam intensity control signal, which varies in accordance with the length of each stroke section to be drawn, which control signal may be applied to intensity circuits to vary the intensity of each stroke in accordance with the length thereof.

2. An apparatus of claim 1, wherein the selected frequency is at least 20 megacycles.

3. An apparatus of claim 1, including means for slanting the character produced on the display at a specified angle, wherein said slanting means includes means for adding a preselected numerical value to said number representative of the slope information, prior to said number being presented to said decoder means.

4. An apparatus of claim 1, including means for increasing the size of the character.

5. An apparatus of claim 4, wherein said size increasing means includes means for increasing the numerical value of the count information prior to the count information being presented to said counter.

6. An apparatus of claim 1, wherein said instruction word further includes beam visibility information and wherein said apparatus includes means responsive to the beam visibility information to control the presence or absence of a trace on the display.

7. An apparatus of claim 1, wherein said retrieving means includes means retrieving the next successive instruction word for a given character whenever said counter is counted down to zero by said clock.

8. A character generator for use with an electron beam controlled display in which the movement of the electron beam to generate a visible character is determined by a set of instruction words, wherein each instruction word in the set includes slope, count and visibility information for generating one straight line portion of a character on the display, each straight line portion comprising a plurality of strokes, the length of the strokes varying depending on the slope of the straight line portion but equal within a given straight line portion, wherein th slope information is a single number representative of the particular slope of the straight line portion on the display and the count information is a number representative of the number of strokes in the straight line portion, and thus determines the length of the straight line portion on the display, the display being arranged so that a character is formed by a series of straight line strokes between matrix points which comprise the display, the distance between successive matrix points in the horizontal direction being referred to as a $\Delta X$ unit value, and the distance between successive matrix points in the vertical direction being referred to as a $\Delta Y$ unit value, the $\Delta X$ and $\Delta Y$ unit values being equal to the shortest stroke generated, the generator comprising:

a. memory means for storing a plurality of instruction words;

b. means responsive to a code identifying a given character for extracting therefrom the address for the set of instruction words in said memory means for drawing said given character;

c. memory address means for storing the address of the set of instruction words for said given character;

d. means for loading said address extracted from said identifying code into said memory address means;

e. buffer storage means for temporarily storing the slope and visibility portions of an instruction word and a counter means capable of being preset to a desired value; p1 f. sequencing means for extracting an instruction word from said memory means and for loading the slope and visibility portions into said buffer storage, and for setting said counter to the value of the count information in the instruction word;

g. a clock set to run at a frequency which is selected so that the period between successive clock pulses corresponds to the desired time to generate a stroke section of the straight line portion of the given character corresponding to the instruction word;

h. means connecting said clock with said counter so that in operation said clock counts down said counter at the selected frequency, wherein said counter produces a counter pulse in responsive to each clock pulse;

i. address updating means responsive to said counter pulse for incrementing said memory address register, which points to the next instruction word in said memory means;

j. means responsive to said buffer means for accumulating, at each counter pulse, the sum of the $\Delta X$ and $\Delta Y$ display values for the successive strokes in successive straight line portions of a character, until the character has been completed, said accumulating means including first and second series connections of an adder/subtractor means, a latch circuit, and means feeding back the output of the latch circuit back to the adder/subtractor means;

k. first and second digital-to-analog converters responsive to the latch circuits for converting the accumulated values of $\Delta X$ and $\Delta Y$ into corresponding analog values which may in turn be applied to deflection circuits in order to move the electron beam on the display sufficiently to produce successive stroke sections of the straight line portion corresponding to the instruction word; and l. gate means responsive to the visibility information in said buffer storage to produce a beam intensity control signal, which varies in accordance with the length of each stroke section to be drawn, which control signal may be applied to intensity circuits to vary the intensity of each stroke in accordance with the length thereof.

* * * * *